US010610081B2

(12) United States Patent
Disch et al.

(10) Patent No.: US 10,610,081 B2
(45) Date of Patent: Apr. 7, 2020

(54) DISHWASHER HAVING A LIQUID TRANSPORTATION LINE

(71) Applicants: Harald Disch, Elzach (DE); Philipp Klumpp, Lahr (DE); Markus Heidt, Kehl (DE); Norbert Litterst, Offenburg (DE)

(72) Inventors: Harald Disch, Elzach (DE); Philipp Klumpp, Lahr (DE); Markus Heidt, Kehl (DE); Norbert Litterst, Offenburg (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 225 days.

(21) Appl. No.: 15/328,302

(22) PCT Filed: Aug. 27, 2015

(86) PCT No.: PCT/US2015/047093
§ 371 (c)(1),
(2) Date: Jan. 23, 2017

(87) PCT Pub. No.: WO2016/036568
PCT Pub. Date: Mar. 10, 2016

(65) Prior Publication Data

US 2017/0209020 A1 Jul. 27, 2017

(30) Foreign Application Priority Data

Sep. 2, 2014 (DE) ..... 10 2014 217 503

(51) Int. Cl.
*A47L 15/42* (2006.01)

(52) U.S. Cl.
CPC ..... *A47L 15/4291* (2013.01); *A47L 15/4212* (2013.01); *A47L 15/4217* (2013.01)

(58) Field of Classification Search
CPC ..... A47L 15/4291; D06F 39/006; F28D 7/106
See application file for complete search history.

(56) References Cited

U.S. PATENT DOCUMENTS 3,946,802 A 3/1976 Christenson
4,219,044 A 8/1980 Wilson
(Continued)

FOREIGN PATENT DOCUMENTS

CN 1853080 A 10/2006
CN 201181172 1/2009
(Continued)

OTHER PUBLICATIONS

PCT, International Search Report and Written Opinion of the International Searching Authority, International Application No. PCT/US2015/047093; dated Oct. 27, 2015, 8 pages.

*Primary Examiner* — Joseph L. Perrin
*Assistant Examiner* — Irina Graf
(74) *Attorney, Agent, or Firm* — Thompson Hine LLP

(57) ABSTRACT

A dishwasher, in particular a commercial single-tank dishwasher or commercial multi-tank dishwasher, for washing washware includes a liquid transportation line (100) with at least one supply line for supplying liquid at a first temperature and comprising at least one discharge line for discharging liquid at a second temperature. The supply line and the discharge line run coaxially in relation to one another, so that either the supply line or the discharge line forms an internal line (10) which runs in the direction of extent of the liquid transportation line (100) within the respectively other supply line or discharge line which for its part forms an external line (20), and thereby form a countercurrent heat exchanger.

12 Claims, 5 Drawing Sheets

(56) References Cited

U.S. PATENT DOCUMENTS

| | | | | |
|---|---|---|---|---|
| 4,228,848 | A * | 10/1980 | Wadkinson, Jr. | F28D 7/106 165/134.1 |
| 4,326,551 | A | 4/1982 | Voorhees | |
| 4,529,032 | A | 7/1985 | Molitor | |
| 4,546,511 | A | 10/1985 | Kaufmann | |
| 5,660,193 | A | 8/1997 | Archer et al. | |
| 5,816,273 | A | 10/1998 | Milocco et al. | |
| 5,829,459 | A | 11/1998 | Milocco et al. | |
| 6,591,846 | B1 | 7/2003 | Ferguson et al. | |
| 8,146,612 | B2 | 4/2012 | Brunswick et al. | |
| 8,162,535 | B2 * | 4/2012 | Glombitza | F16L 55/165 374/120 |
| 8,684,071 | B2 | 4/2014 | Andersson et al. | |
| 2007/0143914 | A1 | 6/2007 | Shirai et al. | |
| 2010/0024844 | A1 | 2/2010 | Brunswick et al. | |
| 2012/0047961 | A1 | 3/2012 | Tarr et al. | |
| 2013/0058725 | A1 | 3/2013 | Duong | |
| 2015/0083379 | A1 | 3/2015 | Ito | |

FOREIGN PATENT DOCUMENTS

| | | | | |
|---|---|---|---|---|
| CN | 102884389 | | 1/2013 | |
| CN | 203561252 | | 4/2014 | |
| DE | 2447428 | | 4/1975 | |
| DE | 3025075 | | 1/1982 | |
| DE | 3227619 | | 2/1983 | |
| DE | 9410453 | | 12/1994 | |
| DE | 4403737 | A1 * | 8/1995 | A47L 15/4291 |
| DE | 102009054345 | A1 | 3/2011 | |
| EP | 2443984 | | 4/2012 | |
| EP | 2614764 | | 7/2013 | |
| FR | 2530326 | | 1/1984 | |
| KR | 20080058129 | | 6/2008 | |
| WO | WO 2011/091940 | | 8/2011 | |
| WO | WO-2014127488 | A1 * | 8/2014 | F28F 27/02 |

* cited by examiner

DISHWASHER HAVING A LIQUID TRANSPORTATION LINE

TECHNICAL FIELD

The present invention relates to a dishwasher, in particular a commercial single-tank dishwasher or commercial multi-tank dishwasher, for washing washware.

BACKGROUND

In the field of commercial dishwashers—be they conveyor-type dishwashers having several liquid tanks or hood-type dishwashers or other stationery machines with only one liquid tank—it is necessary for fresh water to be introduced into the system at least at one point and for used washing water to be discharged from the system at least at one point. Since the fresh water is usually drawn from the public drinking water system or the like, it is at a comparatively low temperature which is not suitable for all dishwashing zones or dishwashing processes. Therefore, final rinsing can of course be performed with comparatively cold fresh water; however, at the latest when the water is intended to be used as cleaning water, for example, in the next dishwashing section of the washing water cascade in the case of a conveyor-type dishwasher or at a corresponding program point in the case of a batch dishwasher and, for example, with a detergent or the like admixed, low washing water temperatures of this kind are no longer sufficient.

If the washing water is now heated to the required temperature as is customary, the question arises of whether the heat remaining in the washing water after said washing water is used, for example by partial or complete replacement of the used washing water with fresh water, can be used.

In the case of commercial hood-type dishwashers, approximately 50% of the supplied thermal energy is discharged as lost heat in the form of heated waste water.

The remainder of the supplied thermal energy remains in the washware or is lost as a result of vapor discharge or the like.

It is known in the art to use the thermal energy in the waste water, before said waste water is discharged to the waste water system, by means of a heat exchanger in such a way that this heat in the outflowing waste water—physically separately from the fresh water—is at least partially transmitted to the supplied fresh water by means of a heat exchanger. The conventional solutions now have the disadvantage that they sometimes do not function reliably enough and, in particular, the waste water remains at a comparatively high temperature when introduced into the waste water system, as a result of which less thermal energy is emitted to the supplied fresh water. This is the result of, for example, heat exchangers which are composed of plastic materials often being used, these having a low thermal conductivity on account of the material used. In addition, plate-type heat exchangers or the like which are used can become clogged if the washing water is heavily soiled (food residues), wherein these food residues collect between the plates of the plate-type heat exchanger and block the liquid channel.

An excessively high waste water temperature is also disadvantageous in that it is not possible to comply with any existing local standards. For example, the US "Uniform Plumbing Code" specifies a maximum waste water temperature of 140° Fahrenheit (60° C.) wherein, if this auxiliary limit cannot be complied with, cold fresh water is often supplied to the waste water in order to comply with the required maximum waste water value.

The invention is therefore based on the object of specifying a dishwasher having a corresponding heat recovery device which operates more reliably than conventional solutions and at the same time has a good energy yield and can be produced in a cost-effective manner.

SUMMARY

The object is achieved, in particular, by a dishwasher for washing washware, wherein the dishwasher has a liquid transportation line comprising at least one supply line for supplying liquid at a first temperature and comprising at least one discharge line for discharging liquid at a second temperature, wherein the supply line and the discharge line run coaxially in relation to one another, so that either the supply line or the discharge line forms an internal line which runs in the direction of extent of the liquid transportation line within the respectively other supply line or discharge line which for its part forms an external line, and thereby form a countercurrent heat exchanger.

In this case, the direction of extent of the liquid transportation line is defined by the flow path of the fluid which is to be supplied or to be discharged and does not necessarily have to run in a straight line.

The fact that the supply line and the discharge line run coaxially in relation to one another results in the particular advantage that, by forming a countercurrent heat exchanger, heat can be transferred in a reliable and efficient manner in such a way that the waste water, which is intended to be discharged by means of the discharge line, is then at a sufficiently low temperature. At the same time, the solution of forming the heat exchanger by coaxial construction from the supply line and the discharge line and realizing said heat exchanger in countercurrent form is very cost-effective.

Advantageous developments of the solution can be implemented.

For example, it is provided that the internal line has a wall which is formed from a material which has a high specific thermal conductivity, and that the external line has a wall which is formed from a material which has a low specific thermal conductivity.

This has the result that good heat exchange can take place between the two fluids (fresh water and waste water) which flow in countercurrent in the interior of the liquid transportation line, wherein undesired emission of heat to the outside is suppressed at the same time. In this connection, it is preferably provided that the material of the wall of the internal line is copper. Copper has a high specific thermal conductivity in the range of from approximately 240 to 400 $W/(m^2 \cdot K)$. In this connection, it can be provided, as an alternative or in addition, that the material of the wall of the external line is a plastic material. The specific thermal conductivity of additive-free plastics lies, for example, in the range of between 0.1 and 0.6 $W/(m^2 \cdot K)$, while plastics with additives have, for example, a specific thermal conductivity of approximately 1 to 10 $W/(m^2 \cdot K)$.

According to a further aspect, it is provided that the liquid which can be discharged by means of the discharge line is waste water and is preferably supplied directly to the waste water system. Since, owing to the solution provided herein, this waste water is at a temperature which is suitable for direct introduction in accordance with strict standards such as, for example, the US "Uniform Plumbing Code" and is generally less than 60° C., it is, owing to the solution provided herein, no longer necessary to supply fresh water to the waste water for cooling purposes in order to comply with this maximum temperature. According to a further aspect, it is provided that the liquid which can be supplied by means of the supply line is fresh water and is preferably drawn directly from the drinking water system.

This results in the particular advantage of the solution provided herein that this fresh water which is drawn directly from the drinking water system and is usually at a relatively low temperature of, for example, 15° C. or the like does not first have to be reheated, but rather can be efficiently heated by the transfer of heat in the countercurrent heat exchanger.

According to a further aspect, the external line is the supply line, and accordingly the internal line is the discharge line. In other words: the hot water is conducted through the internal line of the two lines, while the cool fresh water is introduced into the dishwashing system by means of the external line. This ensures, in particular in combination with a corresponding material selection, optimum transfer of heat from the hot waste water flowing on the inside to the cold fresh water flowing in the opposite direction on the outside, wherein an insulating effect is ensured toward the outside, that is to say in relation to the liquid transportation line toward the outside, at the same time.

In this case, it is particularly provided that the first temperature is lower than the second temperature, and is preferably 30 to 40 K lower, and particularly preferably approximately 45 K lower, than the second temperature.

According to a further aspect, it is provided that a continuous intermediate wall is provided between the wall of the internal line and the wall of the external line. In this case, it is preferably provided that the intermediate wall bears against the internal line at least in regions and preferably by way of more than half of its surface. In this connection, "continuous" means that said intermediate wall runs in the direction of extent of the liquid transportation line substantially as far as the line end, but there can be correspondingly shortened or lengthened in order to be able to create a possible connection.

Sufficiently good heat transfer between the medium flowing through the internal line and the medium flowing through the external line is further possible particularly when the intermediate wall bears against the internal line by way of more than half of its surface; at the same time however the intermediate wall provides additional protection to the effect that unintentional mixing of waste water and fresh water and/or waste water affecting the fresh water system or the like can be effectively prevented.

In this case, it is particularly preferably provided that at least one channel which runs in the direction of extent of the liquid transportation direction is formed between the intermediate wall and the internal line. This at least one channel is connected to the surrounding atmosphere in a pressure-related manner at at least one of the line ends of the liquid transportation line. In other words: this at least one channel forms a leakage gap and, in the event of a leakage, conducts the escaping liquid to at least one of the line ends of the liquid transportation line. In this case, said liquid can be accordingly discharged without there being any risk of it affecting the fresh water system and as a result possibly contaminating the fresh water or drinking water system.

According to an advantageous development of this aspect, the at least one channel is connected to a sensor device in order to identify liquid escaping from the internal line into the channel. In this case, the sensor device can be in the form of a pressure sensor. However, at the same time, it is also possible for the sensor device to be in the form of an optical sensor. An optical sensor of this kind is preferably arranged at at least one of the line ends of the liquid transportation line and serves to identify liquid escaping from the at least one channel.

Both the pressure sensor and an optical sensor of this kind enables simple and reliable identification of a leakage of this kind, wherein, in the event of identification in this way, a liquid blocking device which separates the fresh water-carrying line (external line or internal line) from the fresh water system as soon as a leakage of this kind is identified by means of the sensor. A blocking device of this kind can be, for example, a controllable solenoid valve or the like. As a result, it is possible to reliably suppress an undesired effect (contamination or the like) on the fresh water system, specifically at an early stage when a possible leakage is first identified.

According to a further development, a connection device, in particular a T-shaped connection piece which is composed of plastic, is provided at at least one of the line ends of the liquid transportation line. This connection device has a connection for the external line and a connection for the internal line. When a channel is provided in an intermediate wall, a connection for this at least one channel can preferably additionally be provided. Simple connection of the coaxial liquid transportation line is possible by means of a connection piece, in particular T-shaped connection piece, of this kind.

BRIEF DESCRIPTION OF THE DRAWINGS

Exemplary embodiments will be explained in greater detail below with reference to the drawings, in which.

DETAILED DESCRIPTION

Figure 1:
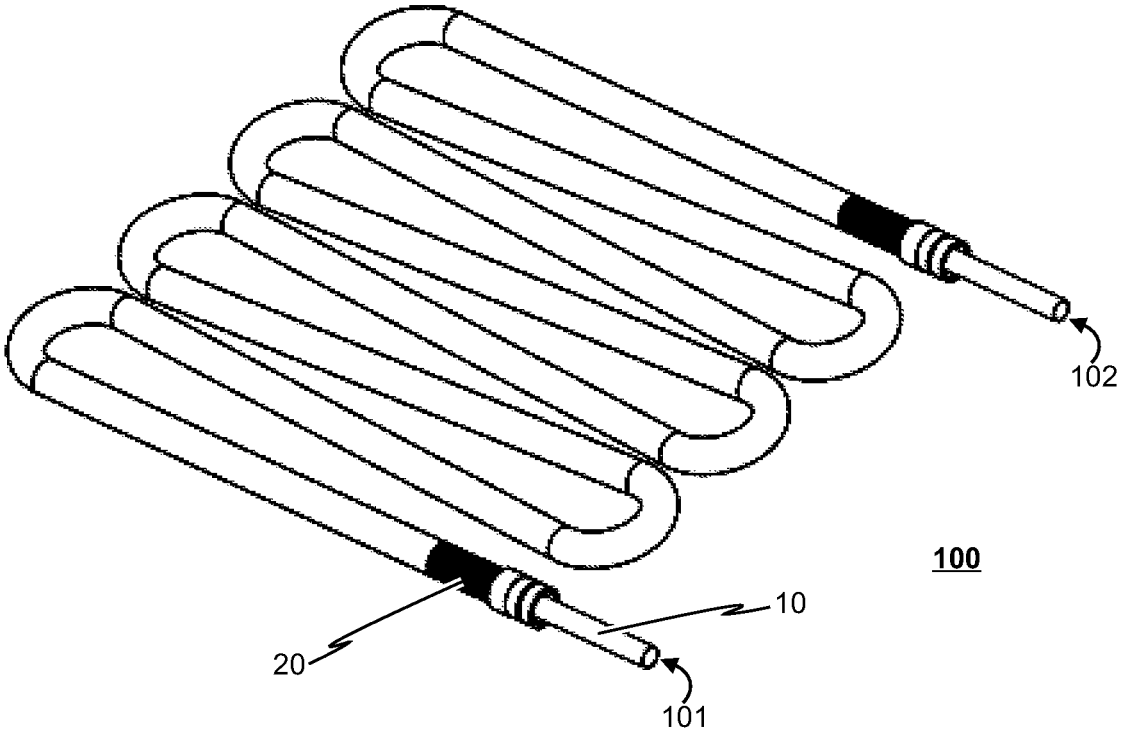
FIG. 1: shows a perspective view of a liquid transportation line for a dishwasher in line with a first embodiment.
Figure 2:
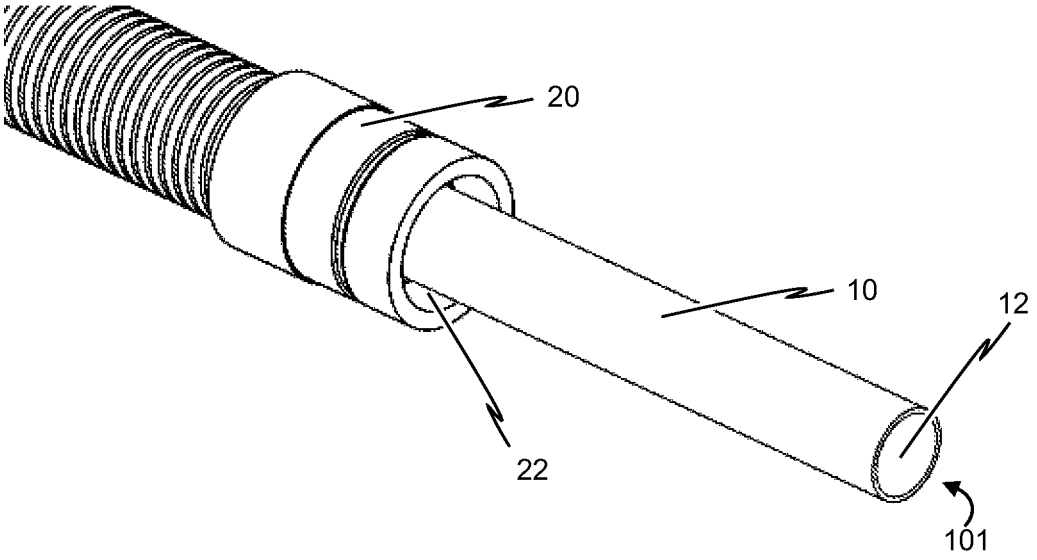
FIG. 2: shows an enlarged region of a line end of the liquid transportation line from FIG. 1.

FIG. 1 shows a perspective view of a liquid transportation line 100 for a dishwasher according to a first embodiment. The liquid transportation line 100 runs in a meandering manner overall and has an internal line 10 which is composed of copper pipe and also has an external line 20 which is composed of a plastic material. As more clearly shown by the enlarged illustration of the line end 101 or 102 in FIG. 2, the liquid transportation line 100 is formed such that the internal line 10 in the form of the copper pipe runs within a corrugated hose which forms the external line 20. The hot waste water is conducted through the metal pipe, that is to say through the internal line 10, while the cold fresh water is routed between said metal pipe (internal line 10) and the corrugated hose (external line 20) in countercurrent. A countercurrent heat exchanger is formed as a result.

Figure 3:
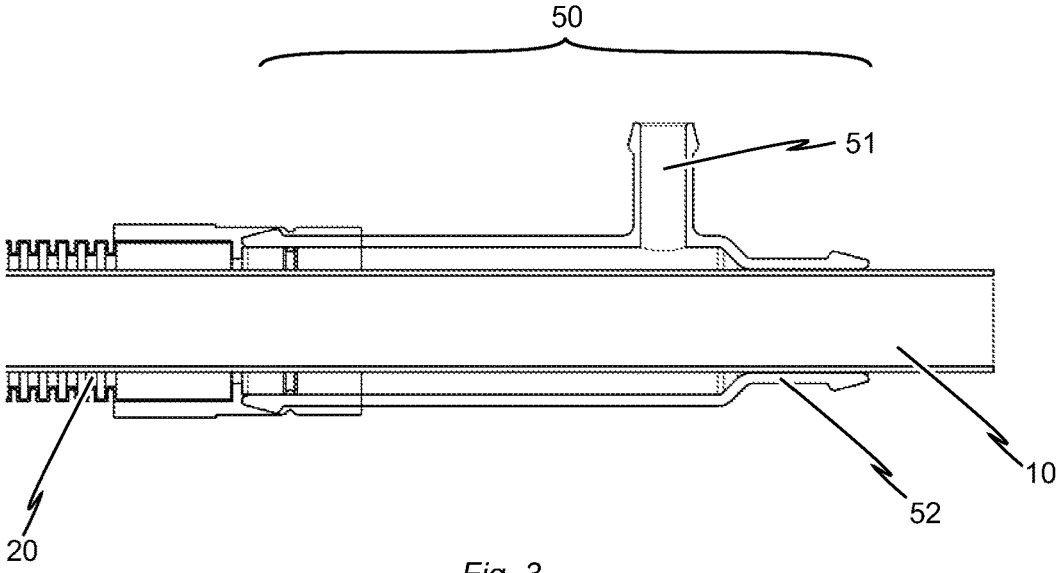
FIG. 3: shows a sectional side view through the line end of the liquid transportation line shown in FIG. 2 level with a dishwasher according to the first embodiment.

As is clear from the sectional side view in FIG. 3, a T-shaped connection piece 50 is provided at one of the two line ends (101, 102), it being possible for the said T-shaped connection piece to be connected in a simple manner to a supply or discharge system by means of a connection 52 for the internal line 10 and by means of a connection 51, which runs approximately at a 90° angle to the connection 52, for the external line 20. To this end, both the connection 51 for the external line and the connection 52 for the internal line have latching lugs, which correspond to a connection plug, or the like for locking purposes.

Figure 4:
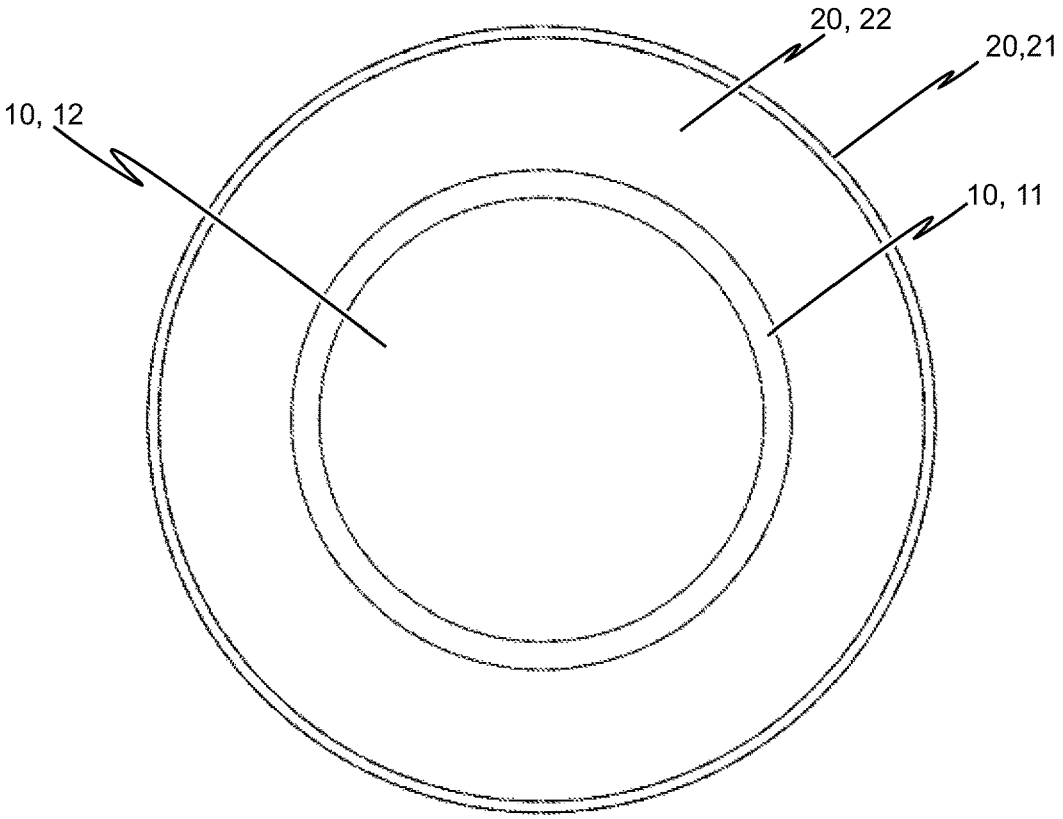
FIG. 4: shows a view of the lumen of the line end from FIGS. 2 and 3.

Therefore, the structure shown in side view in FIG. 4 is the result of looking at the line end from the top. The internal line 10 is therefore limited by a corresponding wall 11, as a result of which a lumen 12 for the liquid transportation is formed in the interior of this wall. The external line 20 accordingly has a wall 21, as a result of which a corresponding lumen 22 of the external line 20 is produced coaxially to the lumen 12 of the internal line 10. The hot waste water is conducted away through the lumen 12 of the internal line 10, while the cooler fresh water, which is generally approximately 40 K cooler, is supplied in countercurrent through the lumen 22 of the external line 20. Particularly effective heat transfer between the media flowing in the lumens 12, 22 is possible in this way.

Figure 5:
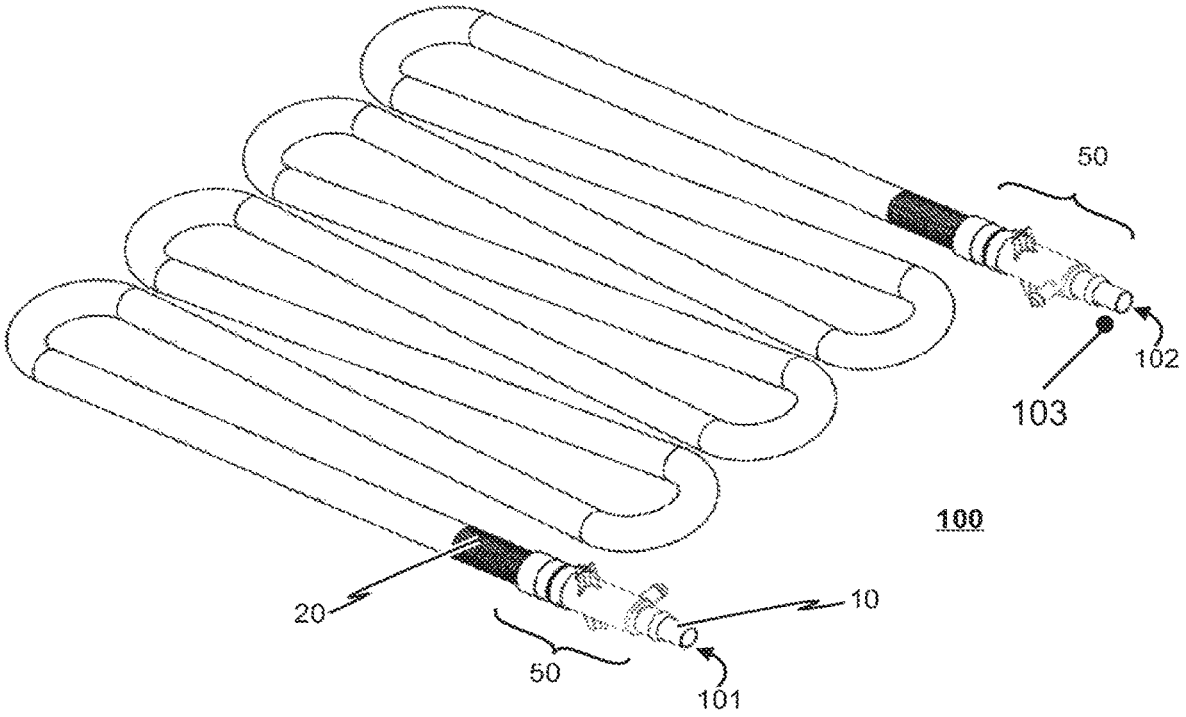
FIG. 5: shows a perspective view of a liquid transportation line for a dishwasher according to a second embodiment.

Analogously to the illustration in FIG. 1, FIG. 5 shows a perspective view of a liquid transportation line 100, but in this case of a dishwasher in line with a second embodiment.

Figure 6:
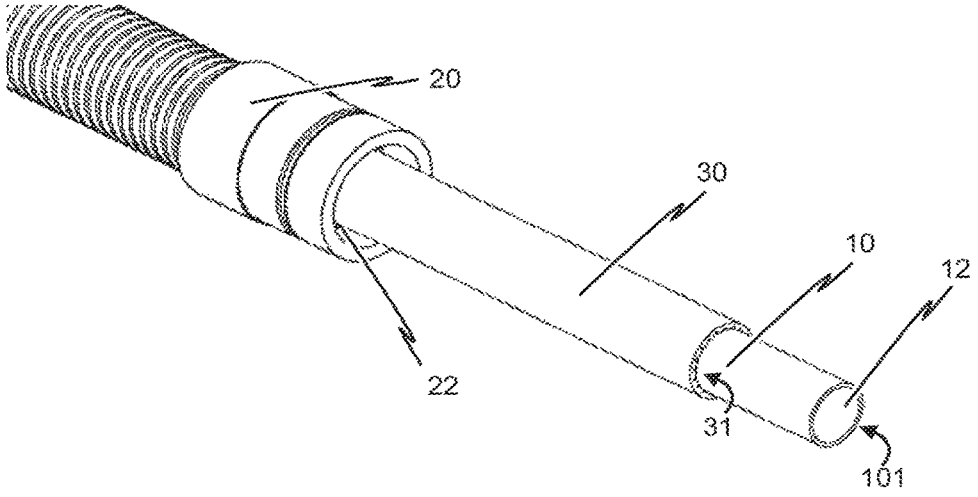
FIG. 6: shows an enlarged detail of a line end of the liquid transportation line from FIG. 5.
Figure 7:
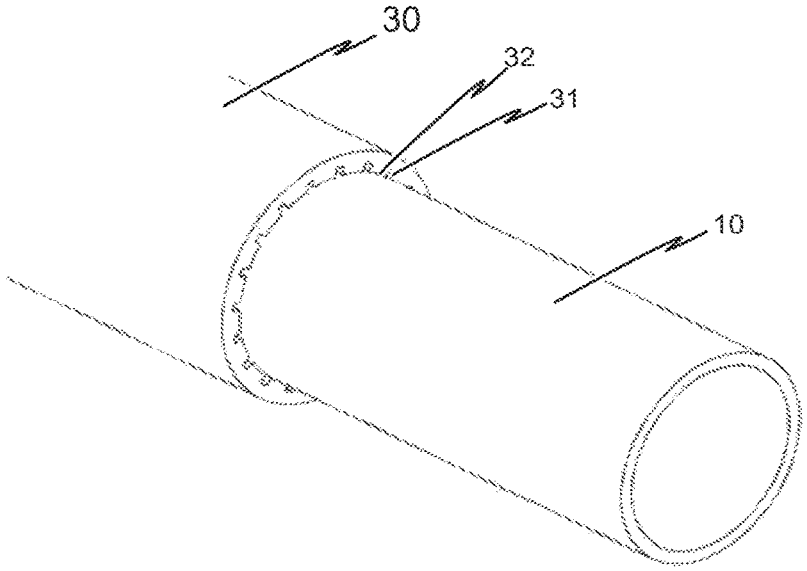
FIG. 7: shows a further enlarged detail of the line end.
Figure 8:
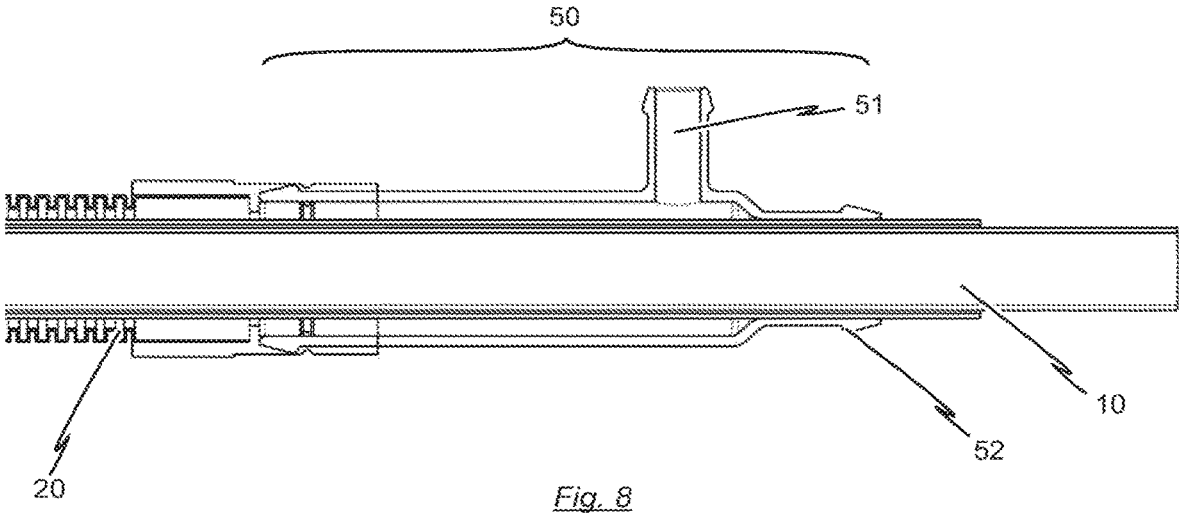
FIG. 8: shows a sectional side view through the line end according to FIG. 6.
Figure 9:
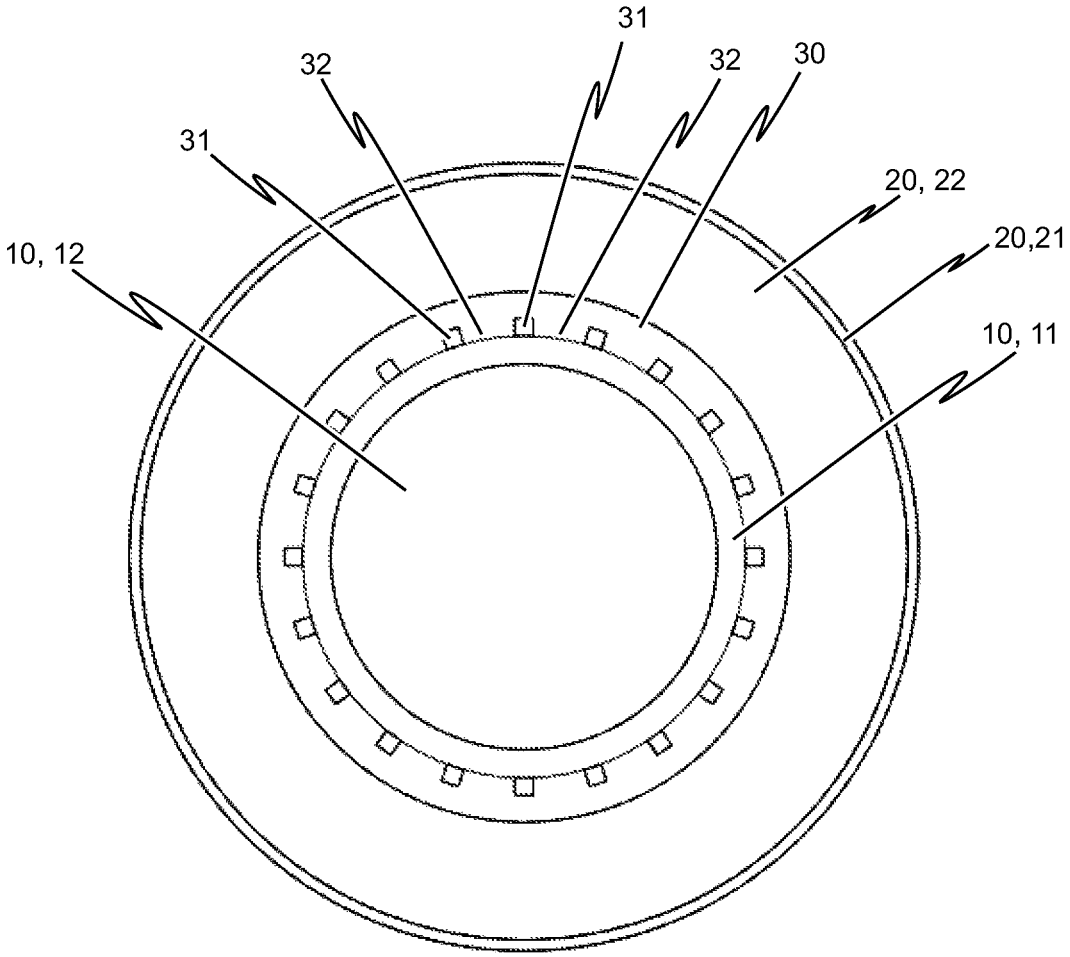
FIG. 9: shows a side view of the lumen of the line end of the liquid transportation line in FIGS. 5 to 8.

As is clear from the enlarged perspective illustration in FIG. 6, an internal line 10 which is composed of copper pipe and an external line 20 which is composed of a corrugated plastic hose are again provided, but, in line with the second embodiment, an intermediate wall 30 is additionally provided in the region of the wall 11 of the internal line 10. The intermediate wall 30 is formed, for example, by pressing with the internal line 10 and is formed from a material which further allows good heat transfer between the lumen 12 of the internal line 10 and the lumen 22 of the external line 20. As is more clearly shown in the illustrations in FIGS. 7 (perspective enlarged illustration of internal line 10 and intermediate wall 30) and FIG. 9 (plan view of the lumen), the intermediate wall 30 bears against the wall 11 of the internal line 10 by way of a large portion of its surface (more than half of its surface). However, a large number of channels, which are denoted 31 altogether, are formed in the other regions.

In other words: adjacent regions 32 of the intermediate wall 30 are provided on the internal line 10, wherein channels 31 which each run in the direction of extent of the liquid transportation line 100 are provided between these adjacent regions 32. These channels 31 are connected to the surrounding atmosphere in a pressure-related manner at at least one of the line ends 101 and/or 102 of the liquid transportation line 100 in the dishwasher in line with the second embodiment.

A sensor device, for example an optical sensor (103), which serves to identify undesired leakages and the like, is provided at the respective line end 101 or 102. It goes without saying that it is equally possible to provide a plurality of intermediate walls 30. In the event of a leakage, in particular a leakage in the internal line 10 which transports the hot waste water in line with the embodiments 1 and 2, the escaping liquid is, in the case of this leakage, therefore conducted to the line end 101 or 102 where it can be collected without the possibility of contamination due to said escaping liquid affecting the fresh water system or the like. At the same time, a signal can be triggered by means of the sensor (not illustrated) by way of a corresponding control device or the like, said signal closing a solenoid valve (likewise not illustrated) or the like as soon as a leakage is identified. In this case, this solenoid valve is provided between the connection 51 for the external line 20 and the fresh water system.

Owing to the solution provided herein, it is possible to provide an effective and low-cost possible way of ensuring heat recovery in a dishwasher, in particular a commercial single-tank dishwasher or commercial multi-tank dishwasher, wherein the waste water temperature of the waste water which is to be introduced is low enough to be able to meet strict standards, such as the US "Uniform Plumbing Code" for example, at the same time. At the same time, in particular when an intermediate wall 30 is provided, pressure-related compensation of the channels 31 which are arranged therebetween is provided at the same time, as is likewise required, for example, by the "Uniform Plumbing Code".

However, owing to the particular construction, in particular owing to the adjacent regions 32, effective heat transfer between the medium flowing in the internal line and the medium routed in countercurrent in the external line is then possible with the proposed coaxial construction. As a result, hot waste water which is at, for example, 60° C. is cooled to below 50° C. in said countercurrent heat exchanger during a normal dishwashing cycle, as a result of which an otherwise usually elevated consumption of fresh water on account of cold water being admixed with said hot waste water before it is introduced into the waste water system is dispensed with.

It should be noted here that all described features of the embodiments have value in combination or on their own. It is to be clearly understood that the above description is intended by way of illustration and example only, is not intended to be taken by way of limitation, and that other changes and modifications are possible.

LIST OF REFERENCE SYMBOLS

10 Internal line
11 Wall of the internal line
12 Lumen of the internal line
20 External line
21 Wall of the external line
22 Lumen of the external line
30 Intermediate wall
31 Channel
32 Adjacent region of the intermediate wall
50 T-shaped connection piece
51 Connection for the external line
52 Connection for the internal line
100 Liquid transportation line
101 First line end
102 Second line end

The invention claimed is:

1. A dishwasher for washing washware, wherein the dishwasher has a liquid transportation line comprising at least one supply line for supplying liquid at a first temperature and comprising at least one discharge line for discharging liquid at a second temperature, wherein the supply line and the discharge line run coaxially in relation to one another, so that one of the supply line or the discharge line forms an internal line which runs in a direction of extent of the liquid transportation line within the other of the supply line or discharge line which for its part forms an external line, and thereby form a countercurrent heat exchanger, wherein a continuous intermediate wall is provided between a wall of the internal line and a wall of the external line, wherein the intermediate wall bears against the internal line at least in regions;

wherein at least one channel is formed between the intermediate wall and the internal line, wherein the at least one channel runs in the direction of extent of the liquid transportation line, wherein the at least one channel is fluidly connected to ambient atmosphere;

wherein the at least one channel is formed by a groove along an inner surface of the intermediate wall.

2. The dishwasher as claimed in claim 1, wherein the internal line has a wall which is formed from a material which has a high specific thermal conductivity, and wherein the external line has a wall which is formed from a material which has a low specific thermal conductivity.

3. The dishwasher as claimed in claim 2, wherein the material of the wall of the internal line is a metal and/or wherein the material of the wall of the external line is a plastic material.

4. The dishwasher as claimed in claim 1, wherein the liquid which can be discharged by means of the discharge line is waste water and is supplied directly to a waste water system.

5. The dishwasher as claimed in claim 1, wherein the liquid which can be supplied by means of the supply line is fresh water and is drawn directly from a drinking water system.

6. The dishwasher as claimed in claim 1, wherein the external line is the supply line, and wherein the first temperature is at least 30 K lower than the second temperature.

7. The dishwasher as claimed in claim 1, wherein the at least one channel is connected to a sensor device in order to detect liquid escaping from the internal line into the channel.

8. The dishwasher as claimed in claim 7, wherein the sensor device is in the form of a pressure sensor.

9. The dishwasher as claimed in claim 7, wherein the sensor device is in the form of an optical sensor which is arranged at at least one line end of the liquid transportation line, in order to detect liquid escaping from the at least one channel.

10. The dishwasher as claimed in claim 1, wherein a T-shaped connection piece which is composed of plastic, having a connection for the external line and having a connection for the internal line is provided at at least one line end of the liquid transportation line.

11. A dishwasher, comprising: at least one tank, and a liquid transportation line comprising at least one supply line and at least one discharge line, wherein the supply line supplies liquid at a first temperature into the dishwasher and the discharge line discharges liquid at a second temperature from the dishwasher, wherein the supply line and the discharge line run coaxially in relation to one another, wherein one of the supply line or the discharge line forms an internal line and the other of the supply line or the discharge line forms an external line, wherein the internal line runs along the liquid transportation line and within the external line to form a countercurrent heat exchanger between the internal line and the external line, wherein a continuous intermediate wall is provided between a wall of the internal line and a wall of the external line;

wherein an inner surface of the intermediate wall bears against the internal line at least in a plurality of regions and the inner surface includes a plurality of grooves that form a plurality of flow channels between the intermediate wall and the internal line, wherein each flow channel runs in a direction of extent of the liquid transportation line, wherein each flow channel is fluidly connected to ambient atmosphere.

12. The dishwasher as claimed in claim 11, wherein each channel is connected to a sensor device in order to detect liquid escaping from the internal line into the channel.

* * * * *